US007089619B2

(12) United States Patent
Smith

(10) Patent No.: US 7,089,619 B2
(45) Date of Patent: Aug. 15, 2006

(54) MULTIPURPOSE TOOL

(76) Inventor: Shawn R. Smith, 53 Pine St., South Easton, MA (US) 02375

( * ) Notice: Subject to any disclaimer, the term of this patent is extended or adjusted under 35 U.S.C. 154(b) by 116 days.

(21) Appl. No.: 10/779,139

(22) Filed: Feb. 17, 2004

(65) Prior Publication Data

US 2005/0177954 A1 Aug. 18, 2005

(51) Int. Cl.
*B25B 7/022* (2006.01)

(52) U.S. Cl. ..... 7/128; 7/107; 7/129; 7/165; 81/424

(58) Field of Classification Search ..... 7/107, 7/108, 128–131, 132–137, 165; 81/421–424, 81/427.5

See application file for complete search history.

(56) References Cited

U.S. PATENT DOCUMENTS 1,748,673 A * 2/1930 Hurst ..... 7/133
3,733,627 A 5/1973 Epstein
3,947,905 A 4/1976 Neff
4,741,059 A * 5/1988 Lee et al. ..... 7/127
4,934,171 A * 6/1990 Konetzke, Jr. ..... 72/409.16
5,212,844 A * 5/1993 Sessions et al. ..... 7/128
5,280,659 A 1/1994 Park
5,497,522 A 3/1996 Chen
5,575,029 A * 11/1996 Simpson ..... 7/137
5,724,688 A 3/1998 Chen
6,009,582 A 1/2000 Harrison et al.
6,088,861 A * 7/2000 Sessions et al. ..... 7/128

* cited by examiner

*Primary Examiner*—Hadi Shakeri

(57) ABSTRACT

A multipurpose tool includes a plurality of elongate handles and a plurality of jaw members pivotally connected to same. A plurality of locking mechanisms are disposed adjacent one opposed end portion of the plurality of handles respectively and preferably include a guide tube and a sliding member including an elongate lower portion selectively movable within the guide tube. A spring member is disposed about the elongate lower portion and limits the movement of the sliding member between relaxed and stretched positions so that plurality of auxiliary tools can be moved between corresponding locked and unlocked positions respectively. A punch tool is removably engageable with the plurality of jaw members and includes a chuck for cutting wires.

18 Claims, 6 Drawing Sheets

MULTIPURPOSE TOOL

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a multipurpose tool and, more particularly, to a multipurpose tool including a mechanism for allowing a user to easily lock/unlock various parts of the tool.

2. Prior Art

Compound, multiple function tools having foldable handles and at least one tool with jaws foldable into the handles are known in the art. Typically, the pliers, or other tool having a pivot able jaw, have a pivot axis and tangs extending from the pivot axis in a direction opposite from the jaw. The tangs are pivotally coupled to the handles. Prior art combination tools have shown jaws that are pivot able about their tangs, either about an axis parallel to the pivot axis of the jaws, or an axis perpendicular to the jaws' pivot axis. Prior art combination tools have also shown jaws that are slidable along the handles of the tool to retract into a channel within the handles.

Multi-function, compact tools typically also include a variety of other tools that may be pivoted into and out of a channel within the handle of the tool for selective use. However, multi-function tools that include a tool having jaw members, such as pliers, typically do not permit access to the remaining tools without opening the handles to also extend the jaw members. Thus, access of a tool other than the pliers often requires more than the single step of extending the desired tool. Moreover, many of such selectable tools are not in an optimum using position when extended out of their respective handles. The selected tool (screwdrivers, in particular) is often in an awkward using position and is generally not aligned to have the greatest amount of center line force transmitted from the user's hand and arm to the tool. Cutting tools generally are positioned so that the handles create a barrier such that the entire length of the sharp edge is not readily usable. Typically, such a barrier is created by having the sharp edge face between the handles and thus spaced from the sides of the tool where the object to be cut, sliced, sawed, etc., is positioned.

Another disadvantage with pivoting of certain models of such tools into and out of their respective channels for use is that once a tool has been extended and locked in place (for those tools that have locks), typically another tool must be extended at least half way to permit the first tool to be replaced into the storage position within its respective channel.

BRIEF SUMMARY OF THE INVENTION

In view of the foregoing background, it is therefore an object of the present invention to provide a multipurpose tool including a mechanism for allowing a user to easily lock/unlock various parts of the tool. These and other objects, features, and advantages of the invention are provided by a multipurpose tool including a plurality of elongate handles and a plurality of jaw members pivotally connected to same so that when the plurality of handles are moved between open and closed positions the plurality of jaw members are caused to move to corresponding open and closed positions. Such a tool is approximately 7 inches long when opened and approximately 4¾ inches long when closed. Of course, the present invention may be manufactured at various sizes according to its intended application and the plurality of handles may be formed from stainless steel or a hard polymer, as well-known to a person of ordinary skill in the art.

The plurality of handles have opposed end portions and the plurality of jaw members include a plurality of substantially annular notches formed therein for allowing a user to strip electrical wires when the jaw members are moved to a closed position. Furthermore, a plurality of non-annular notches are formed in the jaw member for use as a SCOTCHLOK™ crimper when the jaw members are moved to a closed position. The plurality of jaw members also include a wire cutter portion. A punchdown tool is threadably attachable to the threaded nose of the pliers in a clockwise motion. This punch down tool is well-known in the Industry for enabling installers to make faster, more uniform connections with a single push. The blade of the punchdown tool seats and cuts the wire to size at just the right point. Advantageously, a plurality of alternate blades may be retrofitted to the punchdown tool, as desired by a user.

The plurality of jaw members define a pliers head section of the tool that is preferably 2¼ inches long. Such a pliers head section includes the following characteristics: extended nose pliers grip (strips, crimps, grips, cuts and bends); 22–26 AWG wire strippers (place the wire into the desired stripping slot, squeeze the handles and pull to strip the wire); SCOTCHLOK™ crimper (the crimping portion of the pliers are specifically designed for the SCOTCHLOK™ button connectors); wire cutter that can cut up to 14 AWG wire (cuts non-steel cable with ease); and threaded nose piece for removably receiving the punchdown attachment tool.

Such a pliers head portion of the tool folds into the handles. The multipurpose tool further includes a plurality of auxiliary tools connected to one of the opposed end portions of each plurality of handles respectively. The plurality of auxiliary tools are movable between operating and non-operating positions by cooperating with a plurality of locking mechanisms operably connected thereto. The plurality of locking mechanisms allow the plurality of auxiliary tools to be locked and unlocked at corresponding operating and non-operating positions, respectively.

The plurality of locking mechanisms are disposed adjacent one opposed end portion of the plurality of handles, respectively, and preferably include a guide tube and a sliding member including an elongate lower portion selectively movable within the guide tube. A spring member is disposed about the elongate lower portion and limits the movement of the sliding member between relaxed and stretched positions so that select ones of the plurality of auxiliary tools can be moved between corresponding locked and unlocked positions, respectively.

The locking mechanism includes three extended pins in which the middle pin is longer and has a hollowed end that is threaded. Such a middle pin resides in a tube for allowing select ones of the auxiliary tools to pivot thereabout between closed and open positions. The light-loaded spring is disposed about the middle pin for providing resilient motion. When retracted, the two side pins pull upwardly through the side of the handle and with a twist rest in two grooves in the handle while a user selects an auxiliary tool and moves same outwardly from the handle.

After the desired auxiliary tool is acquired, a user simply twists and slides the locking pins out of their grooves for causing the spring to snap the two outer pins back into their respective resting positions or maintaining the auxiliary tool at a substantially secure position during operating conditions. Such a process is repeated in reverse order for positioning the auxiliary tool back to its original location. In operation, a user opens the handles and folds them over the pliers head portion to access the auxiliary tools so that same can be employed at optimum positions.

The multipurpose tool may further include a tool securing member having an aperture formed therein and being connected to one of the plurality of handles and adjacent to one opposed end portion thereof. One of the plurality of auxiliary tools may include a groove formed at one end portion thereof and for unwrapping a wire. In addition, one of the plurality of auxiliary tools may be formed from hardened plastic material. Furthermore, one of the plurality of auxiliary tools may include a pick portion disposed at one end portion thereof.

Such auxiliary tools preferably include a sheath cutter, pick tool, spudger tool, wrap tool and un-wrap tool, for example. The sheath cutter is insertable into a small opening cut in a cable sheath for pulling same downwardly to expose the cable inside. Advantageously, the sheath cutter neatly and cleanly slits the jacket from all sizes of plastic-covered and fabric-covered cables without damaging the wire or the insulation. The pick tool provides access to wires wherein the hook end picks up, separates or removes single wires from a bundle of wires.

The flat-notched end of the spudger tool forms wire by removing solder from terminal blocks and positioning same as selected positions. The wrap tool wraps wire around pins used on communication devices to create solder-less wire wrap connections for 22–24 gauge wire. The un-wrap tool unwraps wire in a counter clockwise motion for 20 –26 gauge wire.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

Figure 1:
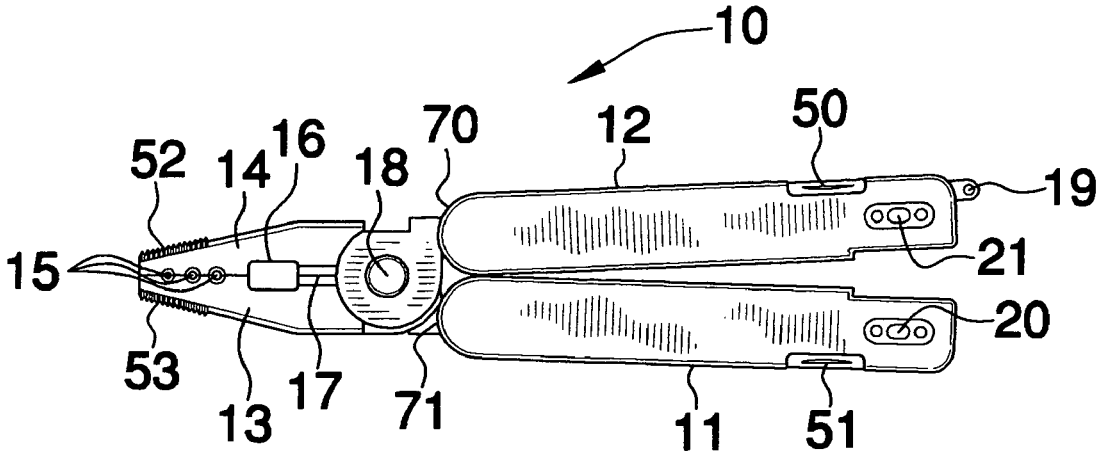
FIG. 1 is a top plan view showing a multipurpose tool at a closed position, in accordance with the present invention.

The apparatus of this invention is referred to generally in FIG. 1 by the reference numeral 10 and is intended to provide a multipurpose tool for use in the telecommunications industry. It should be understood that the apparatus 10 may be used in a plurality of industries and therefore should not be construed as having limited applicability only to the telecommunications industry.

Figure 11:
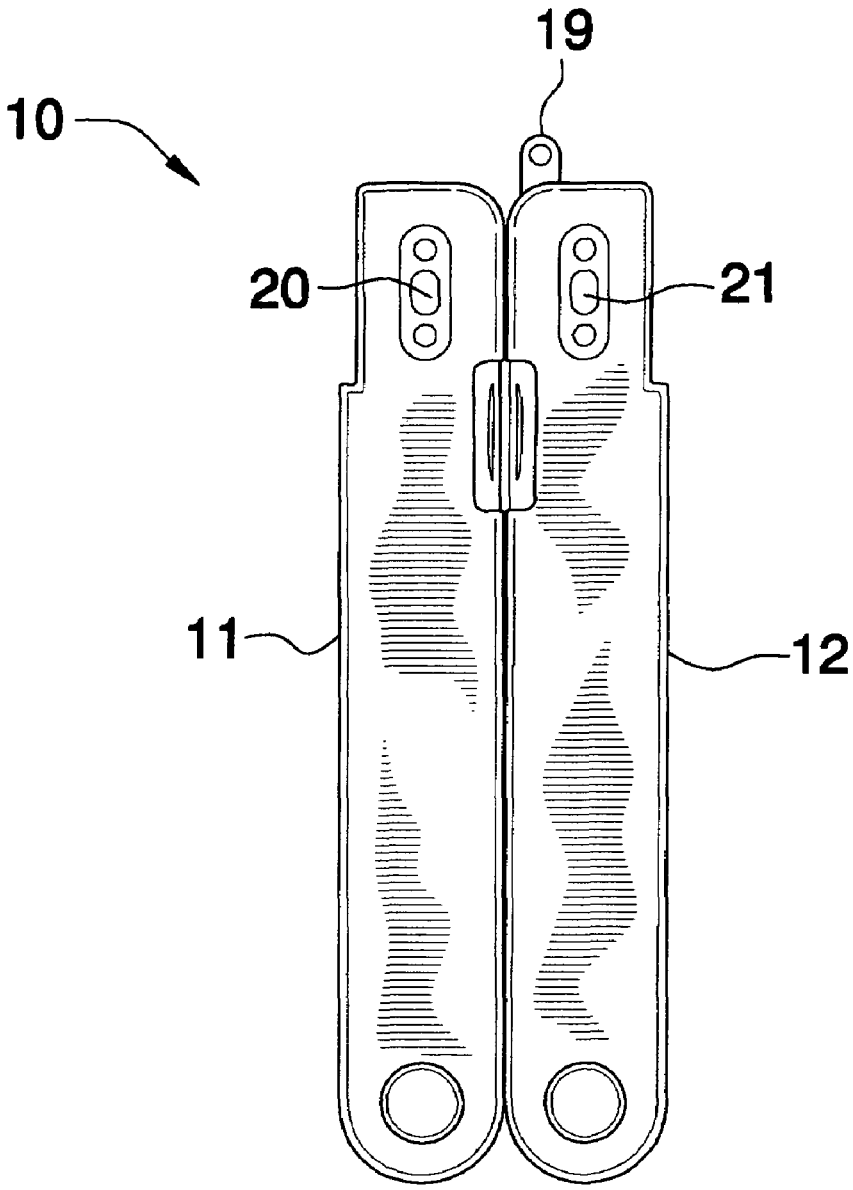
FIG. 11 is a top plan view showing the plurality of handles pivoted about their ends and over the plurality of jaw members.

The apparatus 10 includes a plurality of elongate handles 11, 12 having opposed end portions. Such elongate handles 11, 12 may be pivoted between open and closed positions, as best shown in FIG. 11. The apparatus 10 further includes a plurality of jaw members 13, 14 pivotally connected to one end portion of the handles 11, 12, respectively, so that the jaw members 13, 14 can be moved between open and closed positions by moving handles 11, 12 in corresponding directions. The handles 11, 12 may be padded for providing extra grip. A pin 18 connects the plurality of jaw members 13, 14 to each other and allows same to pivot thereabout.

Jaw members 13, 14 include a plurality of notches 15 formed adjacent an end portion thereof and for stripping telecom wires such as 22, 24 and 26 AWG wires, for example. The notches 15 form substantially annular openings when the jaw members 13, 14 are moved to a closed position and for receiving such wires therethrough. The jaw members 13, 14 further include a SCOTCHLOK™ crimping portion 16 formed generally medially between their opposed end portions, and a wire cutter portion 17 is formed adjacent thereto, as well known in the industry.

Handle 12 includes a tool-securing member 19 attached to an end portion thereof and opposite from jaw members 13, 14. Such a member 19 includes an aperture form therein for assisting a user to hang the tool therefrom or attach a lanyard thereto. Advantageously, handles 11, 12 are pivot able about ends 70, 71 and engageable with each other so that the plurality of jaw member 13, 14 can be covered during non-operating conditions.

Figure 2:
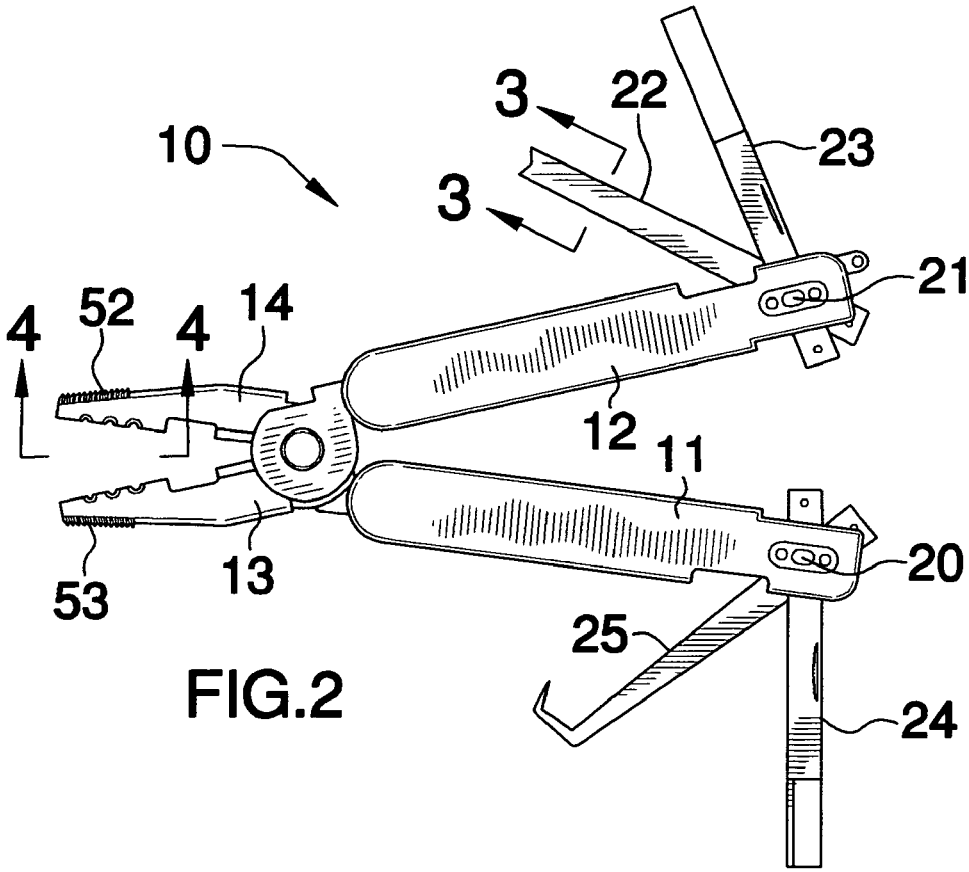
FIG. 2 is a top plan view showing the tool in FIG. 1 at an open position.

Now referring to FIG. 2, the plurality of handles 11, 12 further include a plurality of locking mechanisms 20, 21 attached to an end portion thereof, respectively. Furthermore, a plurality of elongate auxiliary tools 22–25 are connected to the locking mechanisms 20, 21 and adjacent to the end portions of the plurality of handles 11, 12. Such auxiliary tools 22–25 are pivot able about an end portion thereof and are movable between operating and non-operating positions wherein the non-operating position is preferably defined when the tools 22–25 are aligned substantially parallel to the handle 11, 12.

Figure 3:
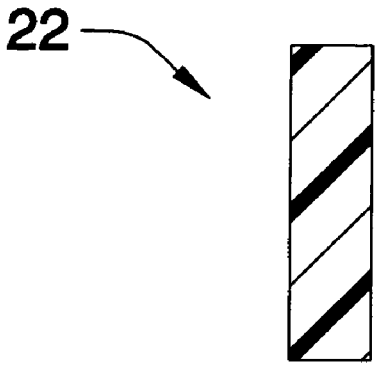
FIG. 3 is an enlarged cross-sectional view taken along line 3—3 in FIG. 2.

Locking members 20, 21 cooperate with such auxiliary tools 22–25 for locking and unlocking same between operating and non-operating positions, respectively. As perhaps best shown in FIG. 3, one of such auxiliary tools 22 is preferably formed from hardened plastic material.

Figure 4:
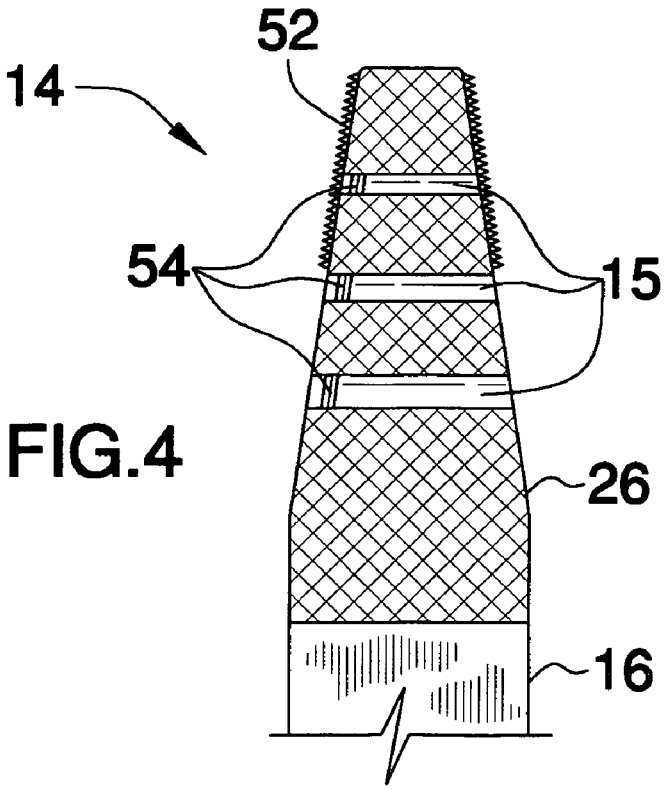
FIG. 4 is an enlarged cross-sectional view taken along line 4—4 in FIG. 2.

Now referring to FIG. 4, jaw member 14 has a hatched surface 26 for assisting a user to maintain a grip on an object during operating conditions. The plurality of notches 15 extend between opposed side edges of jaw member 14 and have substantially smooth services as does crimping member 16. The plurality of jaw members 13, 14 also have a threaded outer surface spaced from the plurality of handles, respectively.

Figure 5:
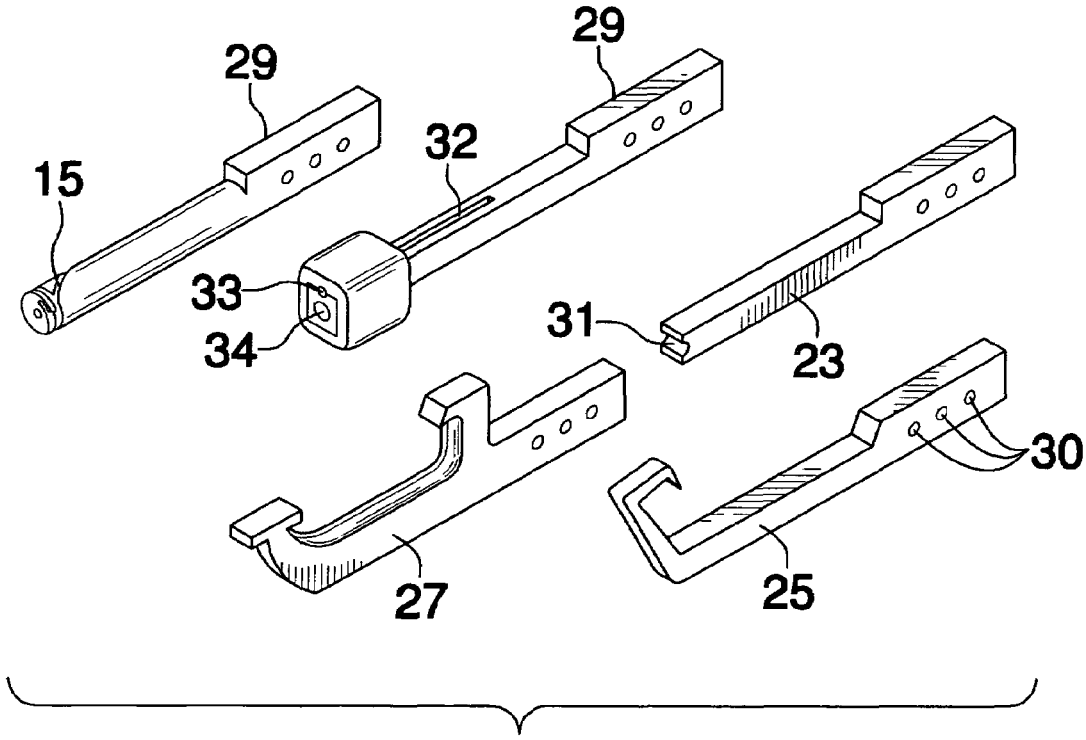
FIG. 5 is a perspective view showing a plurality of auxiliary tools attachable to the multipurpose tool.

Now referring to FIG. 5, a plurality of auxiliary tools 23, 25, 27 and 29 are shown wherein all of such members include a plurality of pinholes 30 formed at an end portion thereof and for operably connecting to a corresponding locking mechanism 20, 21. In addition, auxiliary tool 25 includes a pick portion, auxiliary tool 23 includes a groove portion 31, auxiliary tool 27 includes a sheath culling portion and auxiliary tool 29 includes a pinhole formed at an opposed end portion of pinholes 30 for receiving a wire therethrough. Auxiliary tool 29 may further include a pinhole 34 formed at an end portion thereof with a second pinhole 33 formed thereabove, which connects to a groove portion 32 for guiding a wire therethrough, as well known in the industry. Of course other auxiliary tools may be selectively interchanged with locking mechanisms 20, 21, as well known In the art. Groove portion 31 is used for unwrapping conventional electrician wire.

Figure 6:
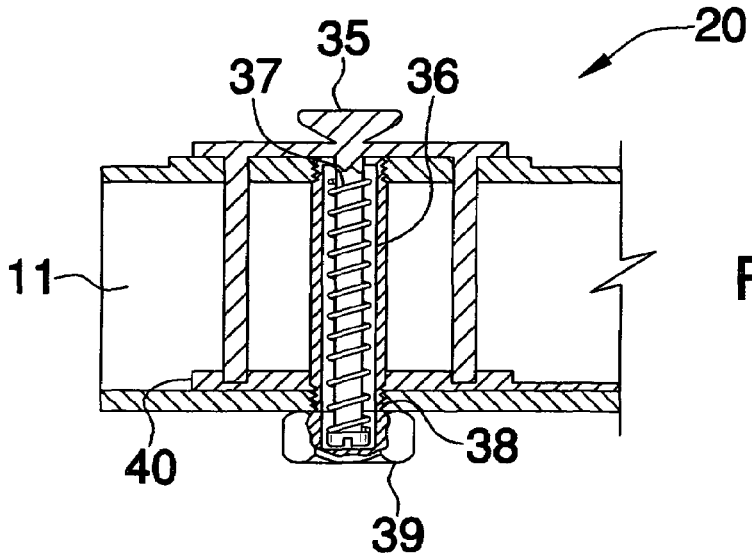
FIG. 6 is an enlarged cross-sectional view of the locking mechanism employed by the present invention.
Figure 7:
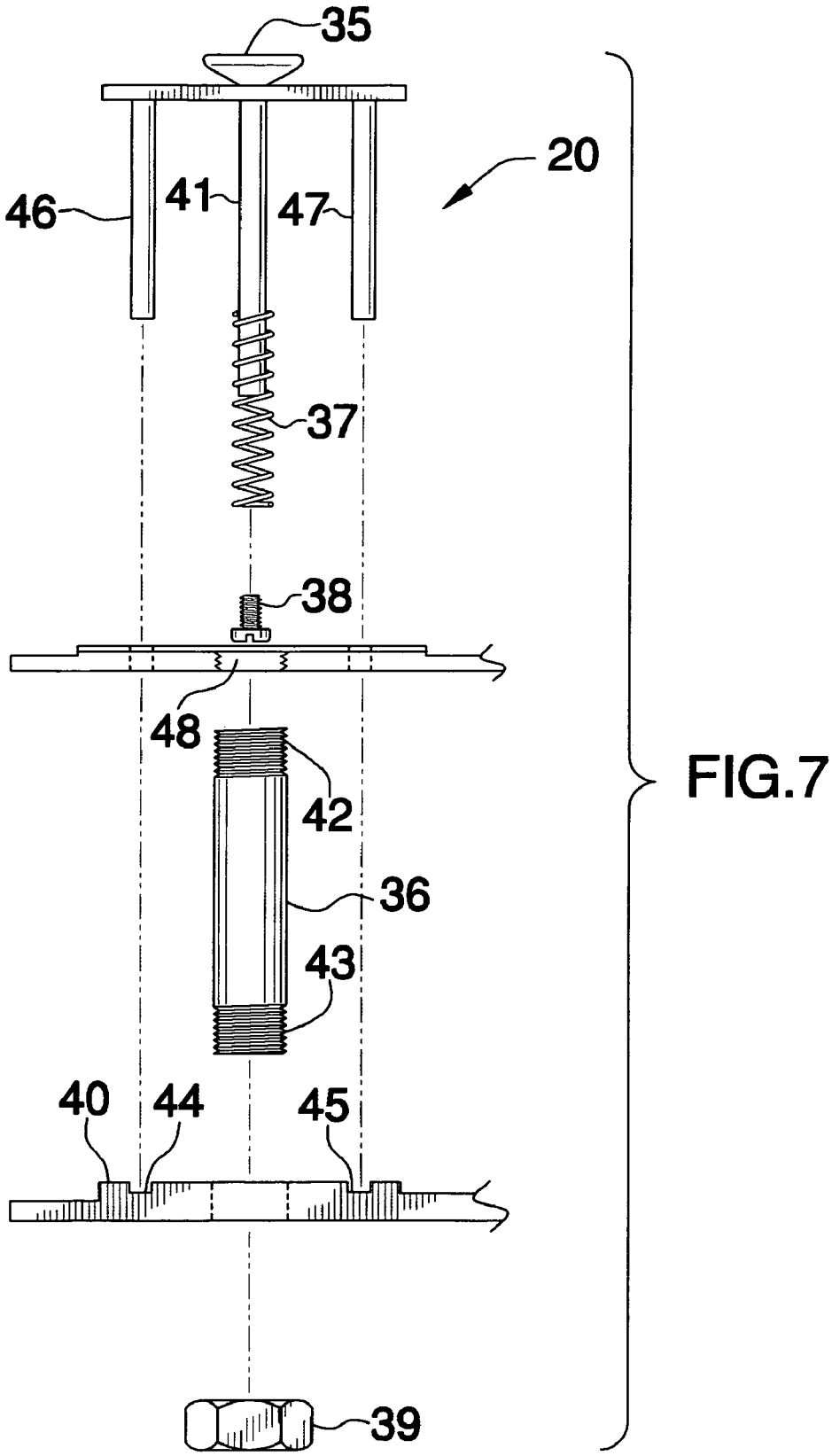
FIG. 7 is an enlarged exploded view of the locking mechanism shown in FIG. 6.

Now referring to FIGS. 6 and 7, it is noted that locking mechanisms 20, 21 include substantially similar structures and, therefore, it is sufficient to understand the operation of both locking mechanisms 20, 21 by describing only locking mechanism 20. Locking mechanism 20 includes a retractable handle 35 disposed above an outer surface of handle 11 and includes a plurality of elongate portions 41, 46 and 47, which are slidably movable within guide tube 36. Elongate portion 41 is surrounded by a spring 37 and is maintained thereabout via a conventional bolt or screw 38 threadably connected to a lower end portion thereof. Guide tube 36 preferably has a hollow interior for repeatedly receiving elongate portion 41 therein and includes threaded opposed end portions 42, 43 connectable to threaded aperture 48 and a conventional nut 39, respectively.

Elongate portions 46, 47 move in sync with portion 41 as the retractable handle is selectively lifted upwardly within guide tube 36. In particular, elongate portions 46, 47 are directed through a pair of apertures and rest in a pair of notches 44, 45 formed in a recessed plate 40 attached to the handle 11. Accordingly, when the retractable handle 35 is moved foreword, it is lifted out of notches 44 and 45 because such notches are formed on the same side of handle 35. Advantageously, the associated auxiliary tools 22–25 become unlocked and are allowed to pivot to an operating position whereby they can be locked in place by simply releasing handle 35 for causing same to move backwards and engage notches 44, 45 so that the auxiliary tools 22–25 become locked in place.

Figure 9:
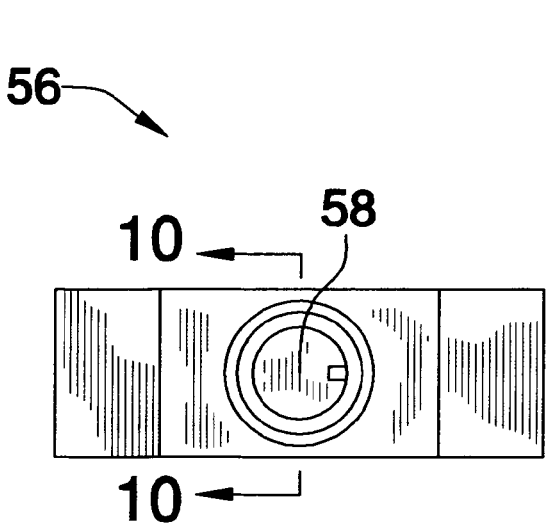
FIG. 9 is a side elevational view taken along line 9—9 in FIG. 8.
Figure 10:
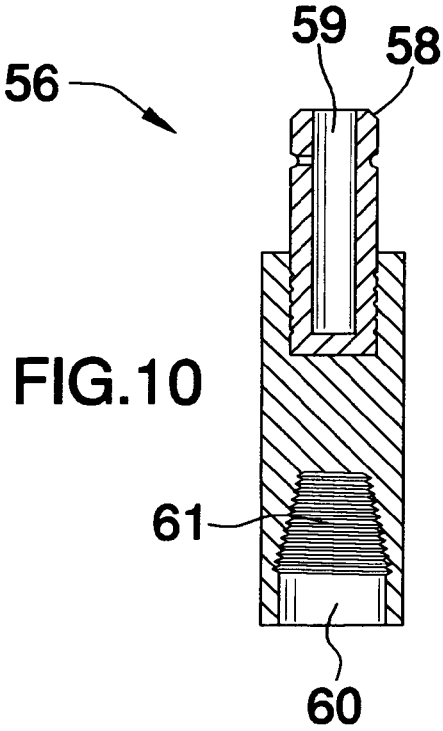
FIG. 10 is an enlarged cross-sectional view taken along line 10—10 in FIG. 9.
Figure 8:
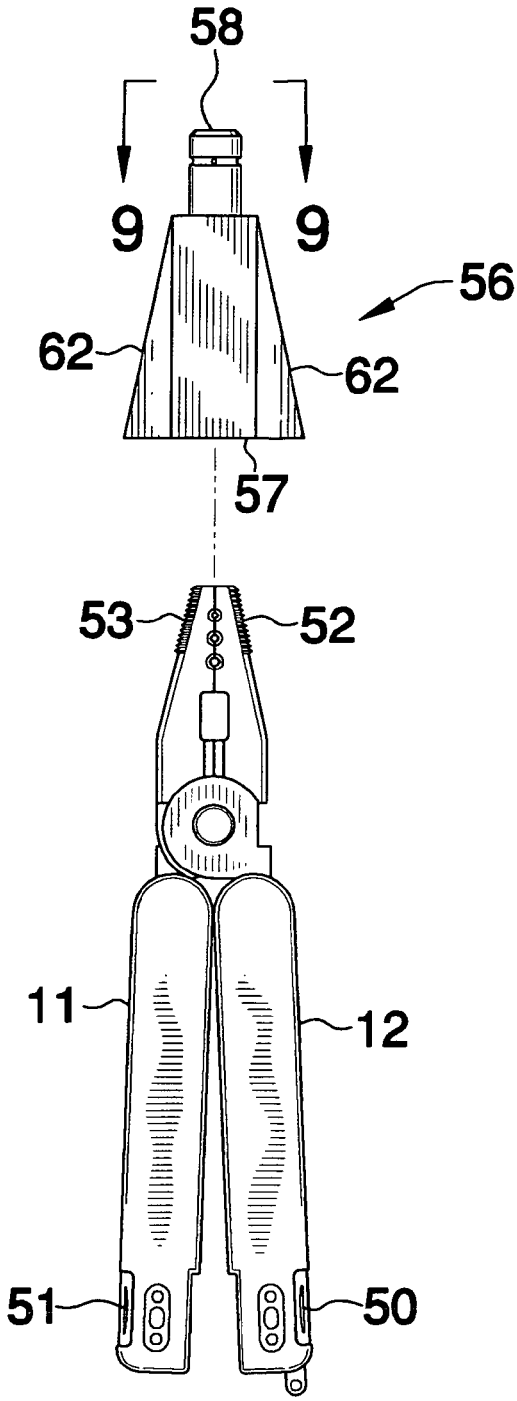
FIG. 8 is a top plan view showing a punch tool threadably attachable to the tool.

Now referring to FIGS. 8–10, the present invention further includes a punch tool 56 including an elongated central portion having a hole 60 defined therein. Such a hole includes a threaded inner surface 61 for selectively engaging the threaded outer surface 52, 53 of the plurality of jaw members 13, 14, respectively. The threaded inner surface 61 extends upwardly and away from the hole 60 so that as it is threadably engaged with the jaw members 13, 14, the punch tool 56 will become tightened therewith. The punch tool 56 further includes a top end portion 58 extending outwardly from the central portion thereof and substantially parallel thereto.

The punch tool 56 further includes a flanged outer portion 62 diverging downwardly along the central portion and is integral therewith. Such a flanged outer portion 62 provides the punch tool 56 with a substantially conical shape so that an operator can readily and easily handle it. Of course, the punch-down tool 56 may include a chuck compatible with standard blade configurations, as well known in the industry.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A multipurpose tool comprising:

a plurality of elongate handles and a plurality of Jaw members pivotally connected to same so that when said plurality of handles are moved between open and closed positions said plurality of jaw members are caused to move to corresponding open and closed positions, said plurality of handles having opposed end portions, said plurality of jaw members having a threaded outer surface spaced from said plurality of handles respectively, said plurality of jaw members comprising a plurality of substantially annular notches formed therein for allowing a user to strip electrical wires when said jaw members are moved to a closed position, a plurality of non-annular notches formed therein for use as a SCOTCHLOK™ crimper when said jaw members are moved to a closed position, and a wire cutter portion;

a plurality of auxiliary tools connected to one said opposed end portions of each said plurality of handles respectively, said plurality of auxiliary tools being movable between operating and non-operating positions;

a plurality of locking mechanisms operably connected to said plurality of auxiliary tools and for allowing same to be locked and unlocked at corresponding operating and non-operating positions respectively; and a punch tool including an elongated central portion having a hole defined therein, said hole including a threaded inner surface for selectively engaging said threaded outer surface of said plurality of jaw members, said punch tool further including a top end portion extending outwardly from said central portion and substantially parallel thereto;

wherein said plurality of locking mechanisms comprise:

a guide tube and a sliding member including an elongate lower portion selectively movable within said guide tube; and a spring member disposed about said elongate lower portion and for limiting the movement of said sliding member between relaxed and stretched positions so that plurality of auxiliary tools can be moved between corresponding locked and unlocked positions respectively.

2. The tool of claim 1, further comprising a tool securing member having an aperture formed therein and being connected to one said plurality of handles and adjacent to said one opposed end portions thereof.

3. The tool of claim 1, wherein said plurality of locking mechanisms are disposed adjacent said one opposed end portions of said plurality of handles respectively.

4. The tool of claim 1, wherein one said plurality of auxiliary tools comprises a groove formed at one end portion thereof and for unwrapping a wire.

5. The tool of claim 4, wherein said one plurality of auxiliary tools is formed from hardened plastic material.

6. The tool of claim 1, wherein one said plurality of auxiliary tools comprises a pick portion disposed at one end portion thereof.

7. The tool of claim 1, wherein one said plurality of auxiliary tools comprises a sheath cutter portion disposed at one end portion thereof.

8. A multipurpose tool comprising:

a plurality of elongate handles and a plurality of jaw members pivotally connected to same so that when said plurality of handles are moved between open and closed positions said plurality of jaw members are caused to move to corresponding open and closed positions, said plurality of handles having opposed end portions, said plurality of jaw members having a threaded outer surface spaced from said plurality of handles respectively, said plurality of jaw members including a plurality of substantially annular notches formed therein for allowing a user to strip electrical wires when said jaw members are moved to a closed position, a plurality of non-annular notches formed therein for use as a SCOTCHLOK™crimper when said jaw members are moved to a closed position, and a wire cutter portion;

a plurality of auxiliary tools connected to one said opposed end portions of each said plurality of handles respectively, said plurality of auxiliary tools being movable between operating and non-operating positions;

a plurality of locking mechanisms operably connected to said plurality of auxiliary tools and for allowing same to be locked and unlocked at corresponding operating and non-operating positions respectively; and a punch tool including an elongated central portion having a hole defined therein, said hole including a threaded inner surface for selectively engaging said threaded outer surface of said plurality of jaw members, said punch tool further including a top end portion extending outwardly from said central portion and substantially parallel thereto; said plurality of locking mechanisms being disposed adjacent said one opposed end portions of said plurality of handles respectively;

wherein said plurality of locking mechanisms comprise:

a guide tube and a sliding member including an elongate lower portion selectively movable within said guide tube; and a spring member disposed about said elongate tower portion and for limiting the movement of said sliding member between relaxed and stretched positions so that plurality of auxiliary tools can be moved between corresponding locked and unlocked positions respectively.

9. The tool of claim 8, further comprising a tool securing member having an aperture formed therein and being connected to one said plurality of handles and adjacent to said one opposed end portions thereof.

10. The tool of claim 8, wherein one said plurality of auxiliary tools comprises a groove formed at one end portion thereof and for unwrapping a wire.

11. The tool of claim 10, wherein said one plurality of auxiliary tools is formed from hardened plastic material.

12. The tool of claim 8, wherein one said plurality of auxiliary tools comprises a pick portion disposed at one end portion thereof.

13. The tool of claim 8, wherein one said plurality of auxiliary tools comprises a sheath cutter portion disposed at one end portion thereof.

14. A multipurpose tool comprising:

a plurality of elongate handles and a plurality of jaw members pivotally connected to same so that when said plurality of handles are moved between open and closed positions said plurality of jaw members are caused to move to corresponding open and closed positions, said plurality of handles having opposed end portions, said plurality of jaw members having a threaded outer surface spaced from said plurality of handles respectively, said plurality of jaw members including;

a plurality of substantially annular notches formed therein for allowing a user to strip electrical wires when said jaw members are moved to a closed position, a plurality of non-annular notches formed therein for use as a SCOTCHLOK™crimper when said jaw members are moved to a closed position, and a wire cutter portion;

a plurality of auxiliary tools connected to one said opposed end portions of each said plurality of handles respectively, said plurality of auxiliary tools being movable between operating and non-operating positions;

a plurality of locking mechanisms operably connected to said plurality of auxiliary tools and for allowing same to be locked and unlocked at corresponding operating and non-operating positions respectively; and a punch tool including an elongated central portion having a hole defined therein, said hole including a threaded inner surface for selectively engaging said threaded outer surface of said plurality of jaw members, said punch tool further including a top end portion extending outwardly from said central portion and substantially parallel thereto; said plurality of locking mechanisms comprise a guide tube and a sliding member including an elongate lower portion selectively movable within said guide tube, and a spring member disposed about said elongate lower portion and for limiting the movement of said sliding member between relaxed and stretched positions so that plurality of auxiliary tools can be moved between corresponding locked and unlocked positions respectively.

15. The tool of claim 14, further comprising a tool securing member having an aperture formed therein and being connected to one said plurality of handles and adjacent to said one opposed end portions thereof.

16. The tool of claim 14, wherein one said plurality of auxiliary tools comprises a groove formed at one end portion thereof and for unwrapping a wire.

17. The tool of claim 16, wherein said one plurality of auxiliary tools is formed from hardened plastic material.

18. The tool of claim 14, wherein one said plurality of auxiliary tools comprises a pick portion disposed at one end portion thereof.

* * * * *